US005888120A

United States Patent [19]

Doran

[11] Patent Number: 5,888,120

[45] Date of Patent: Mar. 30, 1999

[54] METHOD AND APPARATUS FOR CHEMICAL MECHANICAL POLISHING

[75] Inventor: Daniel B. Doran, Fort Collins, Colo.

[73] Assignee: LSI Logic Corporation, Milpitas, Calif.

[21] Appl. No.: 939,689

[22] Filed: Sep. 29, 1997

[51] Int. Cl.[6] ..... B24B 5/00

[52] U.S. Cl. ..... 451/41; 451/8; 451/9; 451/55; 451/285; 451/287; 451/288

[58] Field of Search ..... 45/8, 9, 10, 11, 45/53, 54, 41, 285, 287, 288, 289, 388, 398, 55

[56] References Cited

U.S. PATENT DOCUMENTS

| | | | |
|---|---|---|---|
| 4,391,511 | 7/1983 | Akiyama et al. | 355/40 |
| 4,506,184 | 3/1985 | Siddall | 310/328 |
| 4,666,291 | 5/1987 | Taniguchi et al. | 355/52 |
| 5,094,536 | 3/1992 | MacDonald | 356/358 |
| 5,558,563 | 9/1996 | Cote et al. | 451/41 |
| 5,567,199 | 10/1996 | Huber et al. | 451/398 |
| 5,573,877 | 11/1996 | Inoue et al. | 430/30 |
| 5,584,746 | 12/1996 | Tanaka et al. | 451/41 |
| 5,607,341 | 3/1997 | Leach | 451/41 |
| 5,624,299 | 4/1997 | Shendon | 451/28 |
| 5,643,060 | 7/1997 | Sandhu et al. | 451/285 |

*Primary Examiner*—Eileen P. Morgan
*Attorney, Agent, or Firm*—Duke W. Yee; Wayne P. Bailey

[57] ABSTRACT

A method and apparatus provides a method for polishing a surface of a substrate with a polishing pad. The surface of the substrate is polished using the polishing pad. The surface of the substrate is deformed in response to changes in the polishing pad, wherein deformation of the surface of the substrate increases uniformity in polishing of the surface of the substrate.

18 Claims, 6 Drawing Sheets

METHOD AND APPARATUS FOR CHEMICAL MECHANICAL POLISHING

BACKGROUND OF THE INVENTION

1. Technical Field

The present invention relates generally to the manufacturing of semiconductor devices, and in particular to chemical mechanical polishing of substrates. Still more particularly, the present invention relates to a method and apparatus for actively adjusting conditions used in chemical mechanical polishing of a substrate to improve polishing uniformity of the substrate.

2. Description of the Related Art

In certain technologies, such as integrated circuit fabrication, optical device manufacture and the like, it is often crucial to the fabrication processes involved that the workpiece from which the integrated circuit, optical, or other device is to be formed have a substantially planar front surface and, for certain applications, have both a planar front surface and back surface.

One process for providing such a planar surface is to scour the surface of the substrate with a conformable polishing pad, commonly referred to as "mechanical polishing". When a chemical slurry is used in conjunction with the pad, the combination of slurry and pad generally provides a higher material removal rate than is possible with mere mechanical polishing. This combined chemical and mechanical polishing, commonly referred to as "CMP", is considered an improvement over mere mechanical polishing processes for planarizing or polishing substrates. The CMP technique is common for the manufacture of semiconductor wafers used for the fabrication of integrated circuit die.

Chemical-mechanical polishing (CMP) is performed in the processing of semiconductor wafers and/or chips on commercially available polishers, such as the Westech 372/372M polishers. The standard CMP tools have a circular polishing table and a rotating carrier for holding the substrate.

Difficulties exist ensuring uniformity of polishing of a substrate, such as a silicon wafer using CMP processes. For example, in FIG. 1, a portion of CMP tool 100 is illustrated. CMP tool 100 includes a wafer carrier 102, which provides a vacuum and back pressure through plenum area 104 and holes 106. A vacuum is employed to cause surface 108 of substrate 110 to adhere to wafer carrier 102. CMP tool 100 also includes a primary polish pad 112, which is coupled to primary platen 114. Both wafer carrier 102 and primary platen 114 rotate during CMP processes to polish surface 116 of substrate 110. During rotation, rebound, and other dynamics involving primary polish pad 112 results in deformities of primary polish pad 112, as shown in section 118 of primary polish pad 112. These deformities, resulting from factors, such as pad rebound, result in lower polish rates near edge 120 of substrate 110. Higher polish rates occur just inside edge 120 of substrate 110. In particular, valley 122 and valley 124 result in less polishing occurring in section 126 and section 128 of polish surface 116. Therefore, it would be advantageous to have an improved method and apparatus for CMP that provides for more uniformity of the substrate surface from polishing of the substrate.

SUMMARY OF THE INVENTION

The present invention provides a method for polishing a surface of a substrate with a polishing pad. The surface of the substrate is polished using the polishing pad. The surface of the substrate is deformed in response to changes in the polishing pad, wherein deformation of the surface of the substrate increases uniformity in polishing of the surface of the substrate.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Process variables in the chemical mechanical polishing processing typically include: down-force, wafer carrier back-pressure, wafer carrier rotational speed, primary platen rotational speed, and polishing slurry flow. Selection of a given primary polishing pad leads to adjustment of process variables to achieve desired polishing responses. Uncontrolled variables are compensated for with the above listed parameters but still remain uncontrolled.

Using a standard wafer carrier, air pressure can be applied "behind" the wafer to effectively bow the wafer outward from the wafer carrier surface. This action is performed in an attempt to compensate for polishing non-uniformity. The fundamental problem with this method is that air is a compressible fluid and the resulting "bubble" of air behind the wafer cannot be contained. It will be subject to drifting and its shape will be at best symmetrical to the center of the wafer carrier. No back-pressure setting could be applied to completely compensate for the polish pad rebound effect.

The electrically active wafer carrier provided by the present invention allows control of the wafer shape to compensate for the uncontrolled variables that result from the flexibility of the primary polish pad. Additionally, the electrically active wafer carrier can compensate for wafer bow due to internal stress on the substrate being polished. These internal stresses occur from the stress mismatch between the variety of films deposited on the substrate to be polished prior to the polishing operation.

Figure 1:
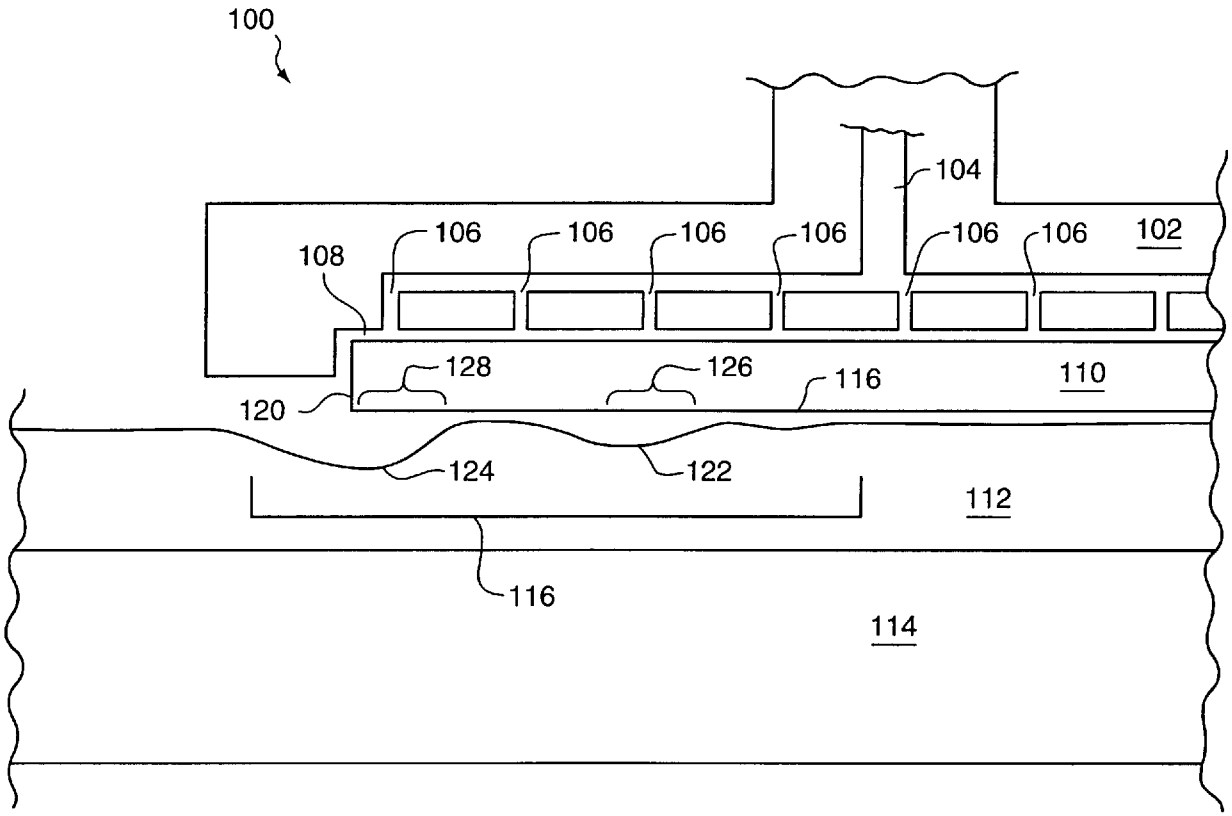
FIG. 1 is an illustration of a portion of a CMP tool in accordance with a preferred embodiment of the present invention.
Figure 2:
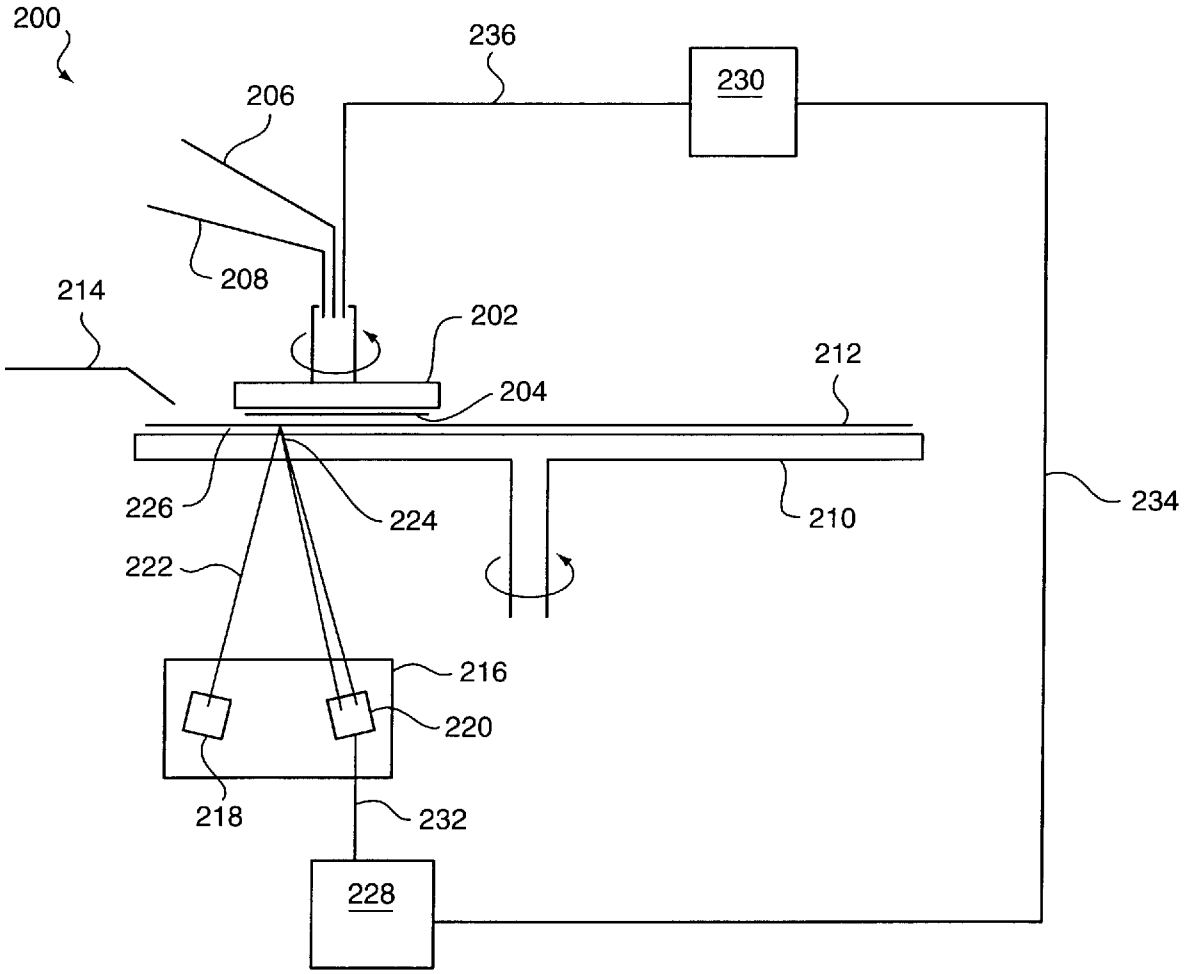
FIG. 2 is a CMP tool in accordance with a preferred embodiment of the present invention.

With reference now to the figures, and in particular with reference to FIG. 2, a CMP tool is depicted in accordance with a preferred embodiment of the present invention. CMP tool 200 is an electrically active wafer carrier that is employed to provide adjustment to the shape of the wafer during CMP operations for improved wafer polishing uniformity. CMP tool 200 includes a wafer carrier 202, which is employed to hold substrate 204 for CMP operations. Wafer carrier 202 is designed to be rotated, which results in rotation of substrate 204. In the depicted example, substrate 204 adheres to wafer carrier 202 by the use of a vacuum applied to the back surface of substrate 204. Wafer carrier 202 includes a wafer carrier vacuum line 206, which provides a vacuum for causing substrate 204 to adhere to wafer carrier 202 during CMP operations. CMP tool 200 may be used to process a number of different types of substrates. Most commonly, CMP tool 200 is used to process a semiconductor wafer, such as a silicon wafer. Additionally, a wafer carrier back pressure air supply line 208 is connected to wafer carrier 202. Back pressure air supply line 208 supplies a specified pressure of air to counteract the bow induced by the wafer carrier vacuum used to hold the substrate in place on the wafer carrier. Both carrier vacuum and back pressure may be applied at the same time.

CMP tool 200 also includes a primary polish platen 210, which also rotates during CMP operations. Primary polish platen 210 holds primary polish pad 212 and rotates this polish pad during CMP operations. Polish slurry line 214 is employed to provide polish slurry, which is applied to primary polish pad 212 for CMP operations used to polish a substrate, such as substrate 204. Additionally, CMP tool 200 includes an in situ film thickness measurement unit 216, containing laser 218 and sensor 220, employed to measure film thicknesses during CMP operations. Alternatively, the CMP operation may be periodically halted for measuring film thicknesses using in situ film thickness measurement unit 216. In situ film thickness measurement unit 216 is a laser based interferometer or similar device based on an optical film thickness measurement. Coherent light beam 222 is passed through a window 224 in the primary polish platen 210 and a corresponding window 226 in primary polish pad 212. Coherent light beam 222 is reflected off substrate 204, through windows 224 and 226 and back to sensor 220 located under primary polish pad 212. In the depicted example, window 226 in primary polish pad 212 should be filled in with a flexible plastic or other similar material to provide a continuous surface for the polishing slurry to flow over during the polishing operation.

Measurements of film thicknesses are sent to film thickness/endpoint analysis and driver interface 228. The film thickness measurement system provides instantaneous film thickness measurements. These measurements when integrated over the surface of the wafer by time can be used to determine a rate of film removal. Additionally, the various removal rates can be used to determine uniformity by and removal rates by user defined zones. The zone data coupled with wafer carrier position data can be fed to an analysis unit within driver module 230. Driver module 230 then sends the appropriate signals to the piezoelectric element array/matrix resulting in the ideal wafer shape to achieve best polishing uniformity (sometimes referred to as polishing non-uniformity). (Lower non-uniformity values are more desirable). Measurements of film thicknesses are sent to film thickness/endpoint analysis and driver interface 228, which is connected to in situ film thickness measurement unit 216 by data line 232.

In turn, measurements of film thicknesses are sent to film thickness/endpoint analysis and driver interface 228 is connected to driver module 230 by data line 234. Driver module 230 provides control signals to a displacement unit containing a number of displacement units (not shown). In the depicted example, the displacement units are piezoelectric elements. The displacement unit is located within wafer carrier 202. These control signals are sent to the piezoelectric elements using control line 236, which couples driver module 230 to the piezoelectric elements located within wafer carrier 202. These control signals are employed to adjust the shape of a substrate, such as substrate 204 as it is processed through CMP.

In the depicted example, displacement units in the form of piezoelectric elements are used to make compensations, such as counteracting the inherent bow of a wafer, to insure the surface of the wafer is flat relative to the polishing pad. These piezoelectric elements also are employed to compensate for any bow in the wafer present to a variety of thermal processing and film stresses encountered by the wafer during semiconductor fabrication processes. This aids in compensating for the overall tendency to have slow center polish rates due to the inability of presently available systems to control the shape of the wafer with current vacuum holding mechanisms. Additionally, the piezoelectric elements also are used to adjust the surface of the wafer being polished to reduce effects from deformations in the polishing pad.

Figure 3:
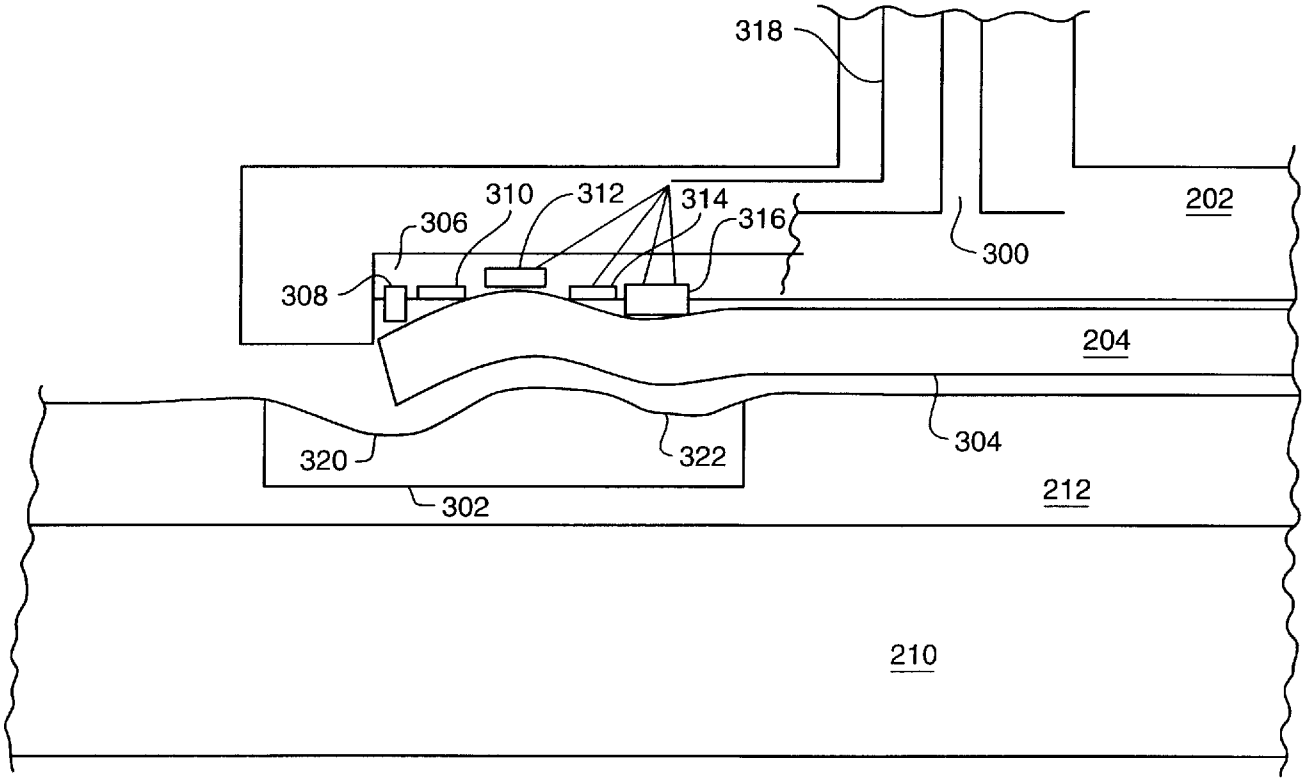
FIG. 3 is a diagram of a portion of the CMP tool in accordance with a preferred embodiment of the present invention.

With reference now to FIG. 3, a diagram of a portion of the CMP tool in FIG. 2 is illustrated in accordance with a preferred embodiment of the present invention. Duplicate reference numerals are used in FIG. 3 to identify corresponding elements from FIG. 2. Wafer carrier 202 has substrate 204 attached to it in FIG. 3. In the depicted example, substrate 204 is a semiconductor wafer. A vacuum is applied to substrate 204 through plenum connection 300, which provides the vacuum to hold substrate 204. As can be seen in this example, primary polish pad 212 has been altered in shape. In particular, deformations are present in section 302 of primary polish pad 212. This deformation of primary polish pad 212 may occur from a number of sources, such as, for example, pad rebound effect. This deformation in section 302 of primary polish pad 212 causes non-uniform polishing of polishing surface 304 in substrate 204.

Displacement unit 306 in the depicted example includes a number of piezoelectric elements 308, 310, 312, 314, and 316, which are used to temporarily deform or bend polishing surface 304 on substrate 204 in response to deformation of primary polish pad 212. Piezoelectric elements 308, 310, 312, 314, and 316, which are coupled to driver module 230 by electrical interface 318. Piezoelectric elements 308 and 316 are in a positive deflection mode, which are used to shape substrate 204. Piezoelectric element 312 is in a negative deflection mode and also is being employed to shape substrate 204. Piezoelectric elements 310 and 314 are in a neutral state in the depicted example.

The bending or deformation of polishing surface 304 is such that uniform polishing of polishing surface 304 and substrate 204 occurs even though the shape of primary polishing pad 212 has been altered. As can be seen in FIG. 3, polishing surface 304 of substrate 204 has been deformed or bent to compensate for low regions 320 and 322 within section 302 of primary polishing pad 212 to minimize the effect of deformation of primary polishing pad 212.

Figure 4A:
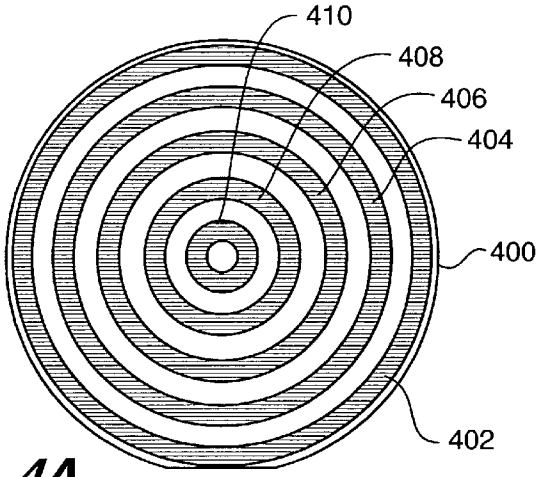
FIGS. 4A–4D are illustrations of configurations for displacement elements in accordance with a preferred embodiment of the present invention.
Figure 4B:
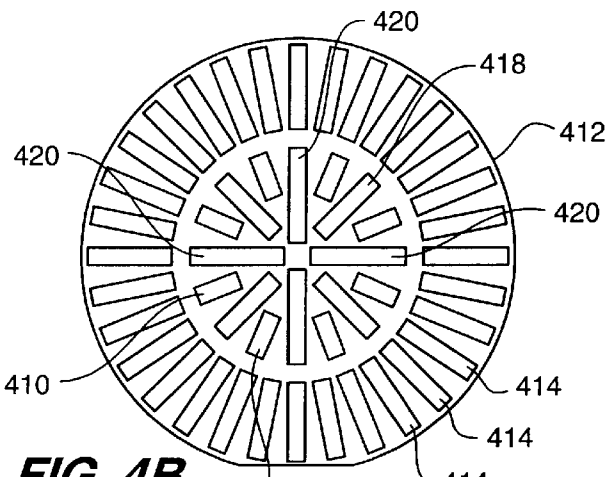
Figure 4C:
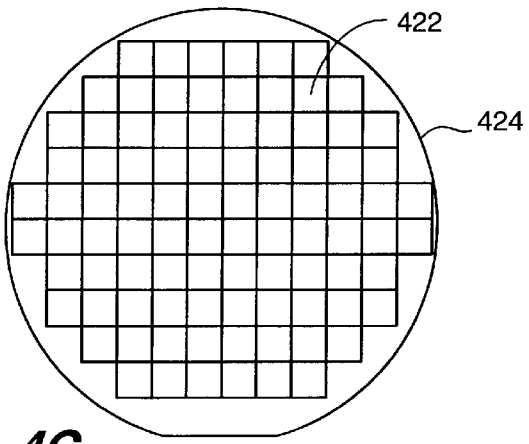
Figure 4D:
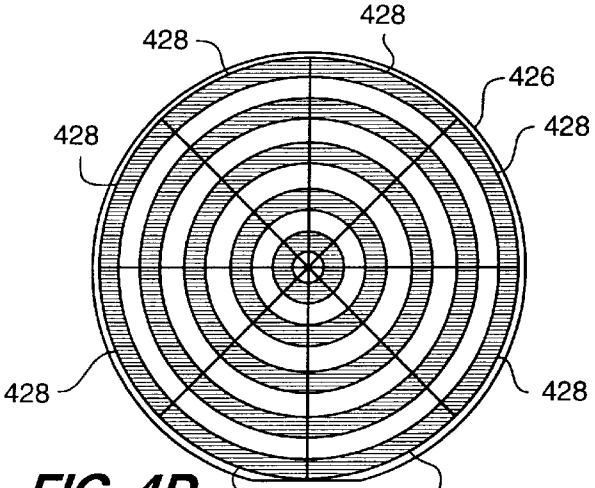

With reference to FIGS. 4A–4D, illustrations of configurations for displacement elements are depicted in accordance with a preferred embodiment of the present invention. These figures depict how displacement elements, such as piezoelectric elements would be arranged within a wafer carrier. The figures show the arrangement on the surface of the carrier that would be used to hold and bend or deform a substrate, such as a semiconductor wafer. In FIG. 4A, wafer carrier 400 contains cocentric rings of piezoelectric elements. In particular, in the depicted example in FIG. 4A, wafer carrier 400 contains cocentric rings 402, 404, 406, 408, and 410. In FIG. 4B, wafer carrier 412 contains interleaved fingers of piezoelectric elements. These piezoelectric elements are found in "fingers", such as in sections 414, 416, 418, and 420. A grid array 422 containing independent piezoelectric elements are employed within carrier 424 in FIG. 4C. In FIG. 4D, carrier 426 contains cocentric rings similar to those used in carrier 402 in FIG. 4A. The cocentric rings in carrier 426, however, are segmented into sections 428. Although FIGS. 4A–4D illustrate specific examples of configurations for piezoelectric elements, any variety of geometric shapes or density of piezoelectric elements may be employed as necessary to achieve the desired shaping of the substrate.

Figure 5:
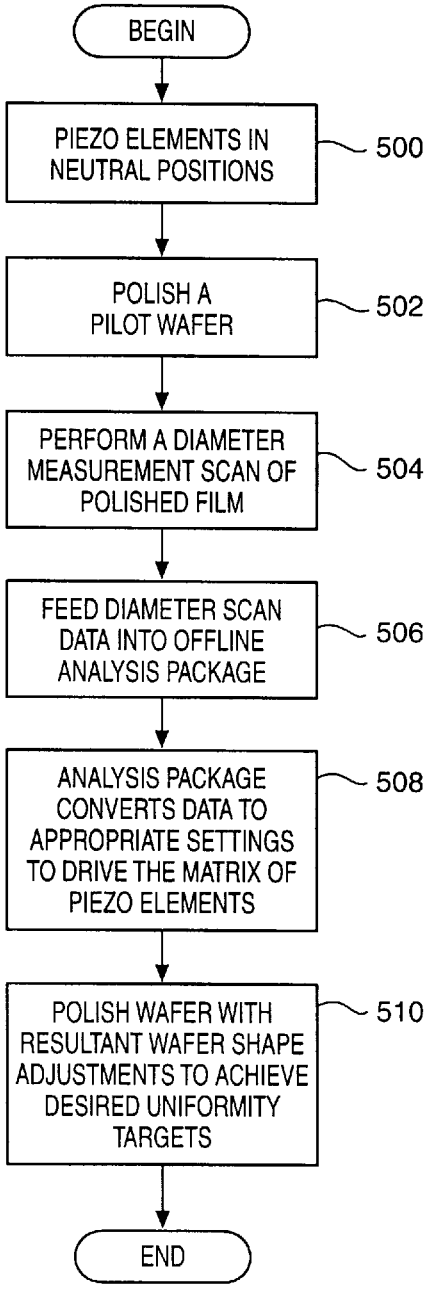
FIG. 5 is a flowchart of a process for CMP using an electrically active wafer carrier system in accordance with a preferred embodiment of the present invention.

Turning now to FIG. 5, a flowchart of a process for CMP using an electrically active wafer carrier system is depicted in accordance with a preferred embodiment of the present invention. The process begins by placing all piezoelectric elements in a neutral position (step 500). Polishing of a pilot wafer then begins (step 502). The pilot wafer is the first wafer in a batch and is used to determine settings for the other wafers in the batch. A diameter measurement scan of the polished wafer is performed (step 504). The diameter scan data is analyzed to identify regions of high and low removal rates (step 506). This step is performed using an off line analysis package. The data is used to obtain appropriate settings to drive the piezoelectric elements in the electrically active wafer carrier (step 508). The wafer is then polished using the settings to achieve desired uniformity in the wafer (step 510). If total film thickness and polishing uniformity are acceptable, then the current settings are used to polishing additional wafers in the batch. Otherwise, use new settings from the analysis to polish other wafers in the batch.

Figure 6:
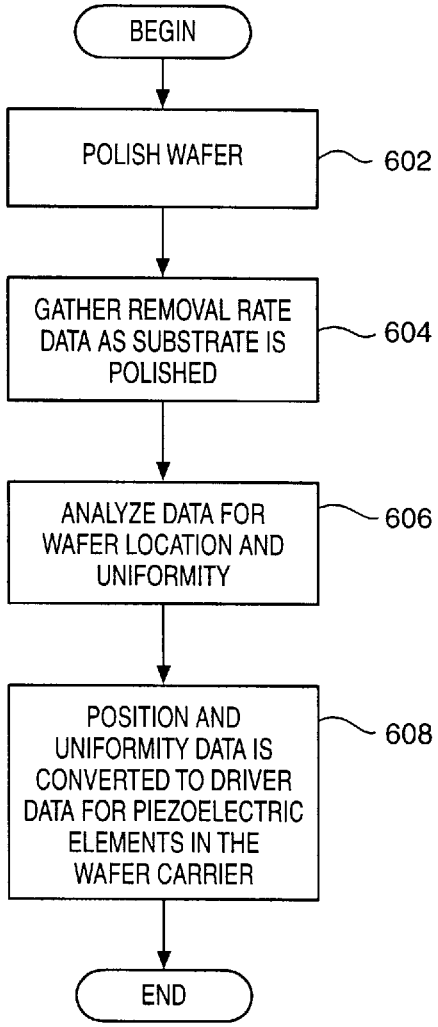
FIG. 6 is a flowchart of a process for adjusting the shape of the wafer during the polishing process in accordance with a preferred embodiment of the present invention.

With reference now to FIG. 6, a flowchart of a process for automatically adjusting the shape of the wafer during the polishing process is depicted in accordance with a preferred embodiment of the present invention. The process in FIG. 6 requires an ability to measure the surface of the wafer being polished during the polishing process. This may be achieved using an electrically active wafer carrier such as the one depicted in FIG. 2. The process begins by polishing the wafer (step 600). As the wafer is being polished, removal rate data is gathered using an apparatus, such as in situ film thickness measurement unit 216 in FIG. 2 (step 602). Data is analyzed for wafer location and uniformity (step 604). The position and uniformity data is converted into address data, which is used to adjust the appropriate piezoelectric elements to achieve the desired uniformity. This analysis would be made using driver interface 228 in FIG. 2. The position and uniformity data is converted into driver data and sent to driver module 230, which adjusts the piezoelectric elements to change the shape of the wafer (step 606). Using this process, the shape of a substrate may be changed while it is being polished without requiring the polishing process to be interrupted for measurements as in FIG. 5.

Therefore, the present invention provides an improved method and apparatus for providing adjustments to a substrate to compensate for factors, such as the bow introduced by the vacuum used to hold the substrate in the carrier as well as for changes in the shape of the polishing pad used during the CMP. By changing the shape of the polishing surface of the substrate in response to changes in the shape of the polishing pad, the method and apparatus of the present invention provides for improved uniformity in the polishing surface of the substrate during the polishing operation. Thus, the present invention provides an advantage over presently available systems by solving problems such as those associated with bending of the wafer and changes to the shape of the polishing pad caused by pad rebound effect. The present invention also solves problems associated with stresses that result from processing of the wafer.

The description of the preferred embodiment of the present invention has been presented for purposes of illustration and description, but is not limited to be exhaustive or limited to the invention in the form disclosed. Many modifications and variations will be apparent to those of ordinary skill in the art. The embodiment was chosen and described in order to best explain the principles of the invention and to enable others of ordinary skill in the art to understand the invention for various embodiments with various modifications as are suited to the particular use contemplated.

What is claimed is:

1. A method for polishing a surface of a substrate with a polishing pad, wherein the polishing pad has a shape, the method comprising:

polishing the surface of the substrate using the polishing pad;

detecting changes in the shape of the polishing pad; and deforming the surface of the substrate in response to detecting changes in the shape of the polishing pad, wherein deformation of the surface of the substrate increases uniformity in polishing of the surface of the substrate.

2. The method of claim 1, wherein the deforming step is performed periodically during the step of polishing.

3. The method of claim 1, wherein the step of deforming the surface of the substrate is accomplished using a plurality of piezoelectric elements.

4. The method of claim 1, wherein the step of detecting is performed using a sensor.

5. The method of claim 1, wherein the detecting step comprises interrupting the polishing step and measuring the surface of the substrate.

6. The method of claim 1, wherein the detecting step comprises measuring the surface of the substrate while the polishing step occurs.

7. An apparatus for polishing a surface of a substrate with a polishing pad, wherein the polishing pad has a shape, the apparatus comprising:

polishing means for polishing the surface of the substrate using the polishing pad;

detection means for detecting changes in the shape of the polishing pad; and deformation means for deforming the surface of the substrate in response to deformation of the polishing pad, wherein deformation of the surface of the substrate increases uniformity in polishing of the surface of the substrate, and wherein the deforming of the surface of the substrate is performed in response to detection of changes in the shape of the polishing pad.

8. The apparatus of claim 7, wherein the deforming by the deformation means is performed periodically during polishing of the surface of the substrate.

9. The apparatus of claim 7, wherein the deformation means comprises a plurality of piezoelectric elements.

10. An apparatus for polishing a surface of a substrate, the appratus comprising:

a carrier, the carrier being configured to hold the substrate;

a polishing pad, the polishing pad having a shape, wherein the polishing pad is used to polish the surface of the substrate;

a deformation unit located within the carrier, wherein the deformation unit is employed to selectively deform the surface of the substrate during polishing of the surface of the substrate such that uniform polishing of the substrate occurs;

a control unit coupled to the deformation unit, wherein the control unit controls the deformation unit; and a sensor, wherein the sensor is configured to detect changes in the shape of the polishing pad and wherein the sensor is connected to the control unit, wherein the control unit sends signals to the deformation unit to deform the surface of the substrate in response to detected changes in the shape of the polishing pad by the sensor to optimize uniform polishing of the surface of the substrate.

11. The apparatus of claim 10, wherein the substrate is a wafer.

12. The apparatus of claim 10, wherein the substrate is a silicon wafer.

13. The apparatus of claim 10, wherein the deformation unit includes a plurality of piezoelectric elements.

14. A chemical mechanical polishing apparatus for polishing a substrate comprising:

a carrier, the carrier being configured to hold the substrate;

a plurality of displacement elements located within the carrier, wherein the plurality of displacement elements is employed to selectively deform the surface of the substrate during chemical mechanical polishing of the surface of the substrate such that uniform polishing of the substrate occurs;

a polishing pad, the polishing pad having a shape, wherein the polishing pad is used to polish the surface of the substrate;

a sensor, wherein the sensor is configured to detect changes in the shape of the polishing pad; and a control unit coupled to the plurality of displacement elements and to the sensor, wherein the control unit sends signals to the plurality of displacement elements to deform the surface of the substrate in response to detected changes in the shape of the polishing pad by the sensor to optimize uniform polishing of the surface of the substrate.

15. The chemical mechanical polishing apparatus of claim 14, wherein the plurality of displacement elements is a plurality of piezoelectric elements.

16. The chemical mechanical polishing apparatus of claim 14, wherein the substrate is a semiconductor wafer.

17. The chemical mechanical polishing apparatus of claim 16, wherein the semiconductor wafer is a silicon wafer.

18. The chemical mechanical polishing apparatus of claim 14, wherein the plurality of displacement elements are arranged in a plurality of cocentric rings.

* * * * *